US007213590B2

(12) United States Patent
Pellerite

(10) Patent No.: US 7,213,590 B2
(45) Date of Patent: May 8, 2007

(54) STABILIZER AND VIBRATION/NOISE DAMPENING DEVICE THAT ATTACHES TO AN ARCHERY BOW

(75) Inventor: Bernard M. Pellerite, 1600 Reynoldsburg New Albany Rd., Blacklick, OH (US) 43004

(73) Assignee: Bernard M. Pellerite, Blacklick, OH (US)

( * ) Notice: Subject to any disclaimer, the term of this patent is extended or adjusted under 35 U.S.C. 154(b) by 73 days.

(21) Appl. No.: 11/157,367

(22) Filed: Jun. 21, 2005

(65) Prior Publication Data

US 2006/0283435 A1 Dec. 21, 2006

(51) Int. Cl.
*F41B 5/12* (2006.01)

(52) U.S. Cl. ..... 124/89

(58) Field of Classification Search ..... 124/89
See application file for complete search history.

(56) References Cited

U.S. PATENT DOCUMENTS 4,615,327 A * 10/1986 Saunders ..... 124/89
5,339,793 A * 8/1994 Findley ..... 124/89
5,975,070 A * 11/1999 Sands ..... 124/89
6,076,514 A * 6/2000 Adams, Jr. ..... 124/89
6,283,109 B1 * 9/2001 Wiseby et al. ..... 124/89
6,681,755 B2 * 1/2004 Pujos ..... 124/89

* cited by examiner

*Primary Examiner*—John A. Ricci

(57) ABSTRACT

A stabilizer for balancing/leveling an archery bow, dampening vibration and reducing the noise of releasing the arrow. The stabilizer housing can be easily opened and re-closed securely by the user, who can remove, replace, and change the contents, which includes extra elastomer modules of varying weight to get the exact desired weight, side-to-side and/or front-to-back balance, and/or vibration and sound dampening effect. The contents consist of removable soft, dense elastomer modular units, some with, some with no molded weights inside, which could be steel, lead shot, ball bearings, weight rods, fluid-filled capsules, or any combination of these, that absorb vibration and sound. One or more of these stabilizer units can also be securely placed in a position not normally available, because of the limitations and configuration of most archery stabilizers and/or bow handle/risers. For instance, they can be affixed to the limb bolts and/or the back of the bow handle riser.

4 Claims, 4 Drawing Sheets

STABILIZER AND VIBRATION/NOISE DAMPENING DEVICE THAT ATTACHES TO AN ARCHERY BOW

This application claims priority to Provisional Application Ser. No. 60/392,866 filed Jul. 2, 2002.

FIELD OF THE INVENTION

This invention is in the field of archery bow stabilizers/noise dampeners/shock absorber/balancers.

DESCRIPTION OF PRIOR ART

Most archery bows tend to vibrate and kick upon release of the arrow, resulting in arm fatigue and, in some cases, even injury, over long periods of time. The main objective of these inventions are to provide balance for a steady and level hold and to help dampen any inherent vibrations and/or bow kick and to reduce noises that occur at release of the arrow. This is accomplished by attaching to the bow various objects, generally known in the industry as "stabilizers." These are normally attached to the bow, under the handle, either in back or front, but can also be attached where the bow limbs meet the handle/riser, or almost anywhere on the bow handle. The contents of ordinary stabilizers are non-removable by the archer and are sealed inside the stabilizer unit by the manufacturer. Most stabilizers are made from hollow tubular aluminum, carbon fiber or other lightweight materials. The inside contents of the tubular stabilizers vary from fluid, granular steel, granular rubber, lead or solid elastomer, none of which can be altered, controlled or removed by the archer, only by the manufacturer.

Representative examples of archery bow stabilizer devices are found in U.S. Pat. Nos. 6,283,109 and 6,494,196.

SUMMARY OF THE INVENTION

A unique feature of this device is that the material inside this invention can be controlled by the archer.

Another unique feature of this device is that the housing of the stabilizer can easily be opened and re-closed by the archer.

Another unique feature of this device is that the weighted contents can be removed, replaced, adjusted, changed, added to or subtracted from, in order to get the precise desired weight, balance and/or vibration and sound dampening effect.

Another unique feature of this device is the variable internal modules are made of extremely soft, dense elastomer, that may or may not have weights, or other vibration dampening material, molded inside them. The contents of these variable weighted internal elastomer modules can include, but are not limited to, steel or lead shot, ball bearings, metal weight rods, capsules filled with fluid, or fluid plus weighted pellets, sealed liquid packets, or packets and/or bags of granular material, or a combination of granular weight inside of a liquid in a capsule or sealed receptacle. Any or all of these can be suspended and/or sealed and/or molded inside the elastomer or packed snugly inside the stabilizer housing.

This weighted material and/or fluid suspended in the elastomer absorbs vibration and sound, and the vibration and sound then is dissipated and/or absorbed further by the elastomer, and then the actual housing further absorbs sound and vibration. The archer can use different size and/or weighted internal sections or modules, packets, or bags that fit and/or stack snugly inside the housing of the stabilizer, and customize or change them, at will, to get the exact weight, balance and/or amount of vibration and sound dampening desired personally by that particular archer.

These packets or capsules can also vary in size and weight and can be used with or without the elastomer encapsulating them. The size and weight of these internal vibration dampening modules, sections, bags or packets are only limited by the inside volume of the tube or container housing that attaches to the bow.

A unique feature of this design is that the contents can consist of weighted material inside replaceable packets, bags or modular units of various lengths and/or mass weights, without the elastomer. The weighted material can be made of steel shot, ball bearings, weight rods, capsules filled with fluid, or fluid plus weighted pellets, etc.

Another unique feature of this design is that two or more stabilizers or housings can also be joined together with a rubber O-ring compressed between them, to make longer, or different configurations of, modular stabilizers with adjustable internal variable weight components.

BRIEF DESCRIPTION OF THE DRAWINGS

The drawings show different features of a bow stabilizer, according to preferred embodiments of this invention, wherein.

REFERENCE NUMERALS

1. Tubular Hollow Stabilizer Housing
2. Canister-Type Hollow Stabilizer Housing
3. Canister-Type Hollow Stabilizer Housing Lid
4. Other Shaped Hollow Stabilizer Housings, such as Rectangular, Octagonal or Hexagonal
5. Hollow Chamber
6. Threaded Hole
7. Threaded Rod or Stud
8. Threaded Holes in Archery Bow

9. Open Threaded End of Tubular Stabilizer Housing
10. Open Smooth End of Tubular Stabilizer Housing
11. Smooth Internal Surface of Tubular Stabilizer Housing
12. Threaded Surface of Stabilizer Housing
13. Smooth Insert
14. Threaded Hole in Smooth Insert
15. Threaded Removable Insert
16. Threads of Threaded Removable Insert
17. Threaded Hole in Threaded Removable Insert
18. Textured (Knurled) Surface
19. O-Ring Grooves
20. O-Ring
21. Elastomer
22. Hole in Elastomer Modules
23. Packet Suspended in Elastomer Modules
24. Ball Weights
25. Weight Rods
26. Capsules of Fluid Suspended in Elastomer
27. Fluid Capsules with Weight Pellets
28. Set Screw Hole
29. Set Screw

DESCRIPTION OF THE PREFERRED EMBODIMENTS

Figure 1:
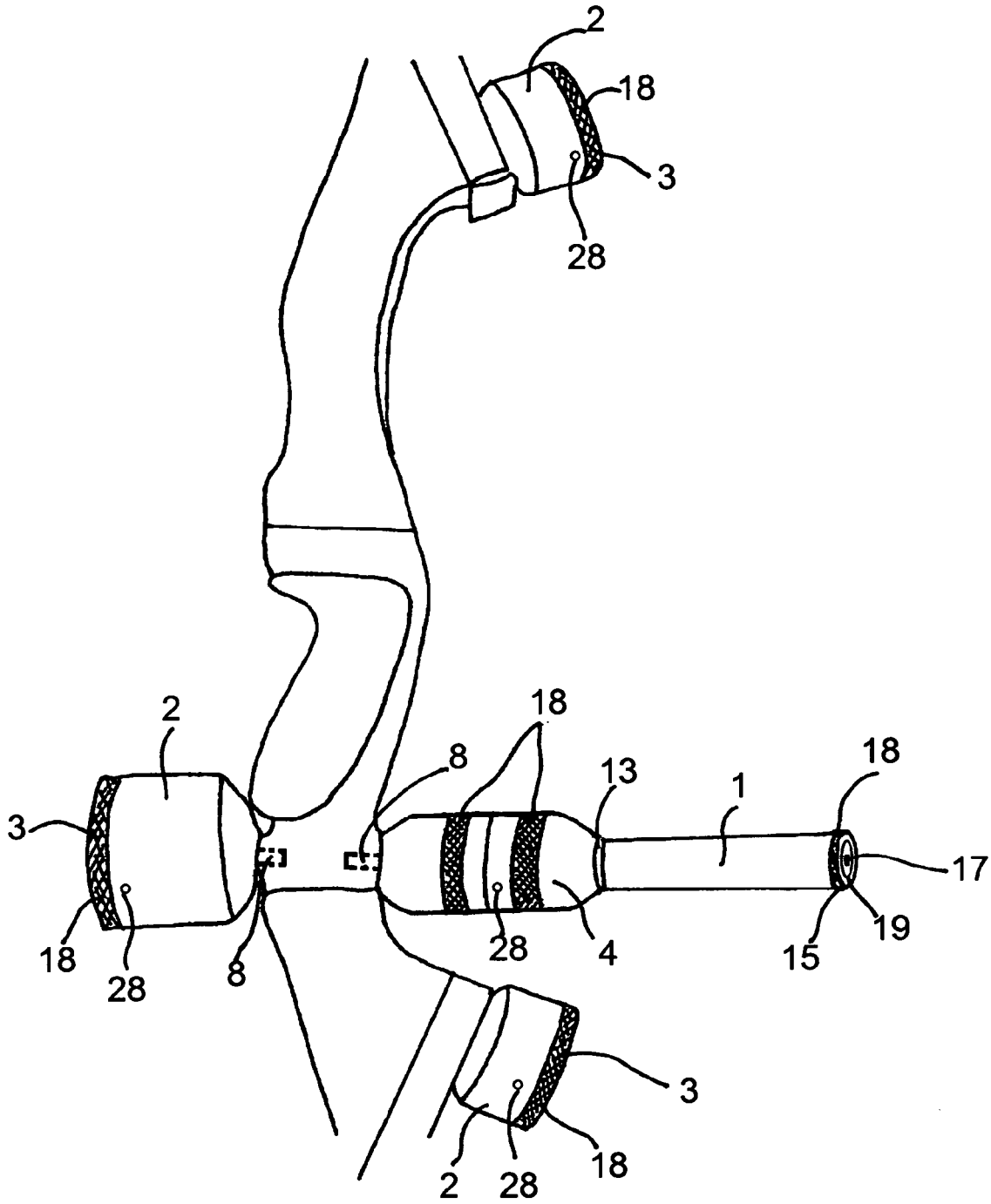
FIG. 1 Shows various shaped stabilizers mounted on an archery bow.
Figure 10:
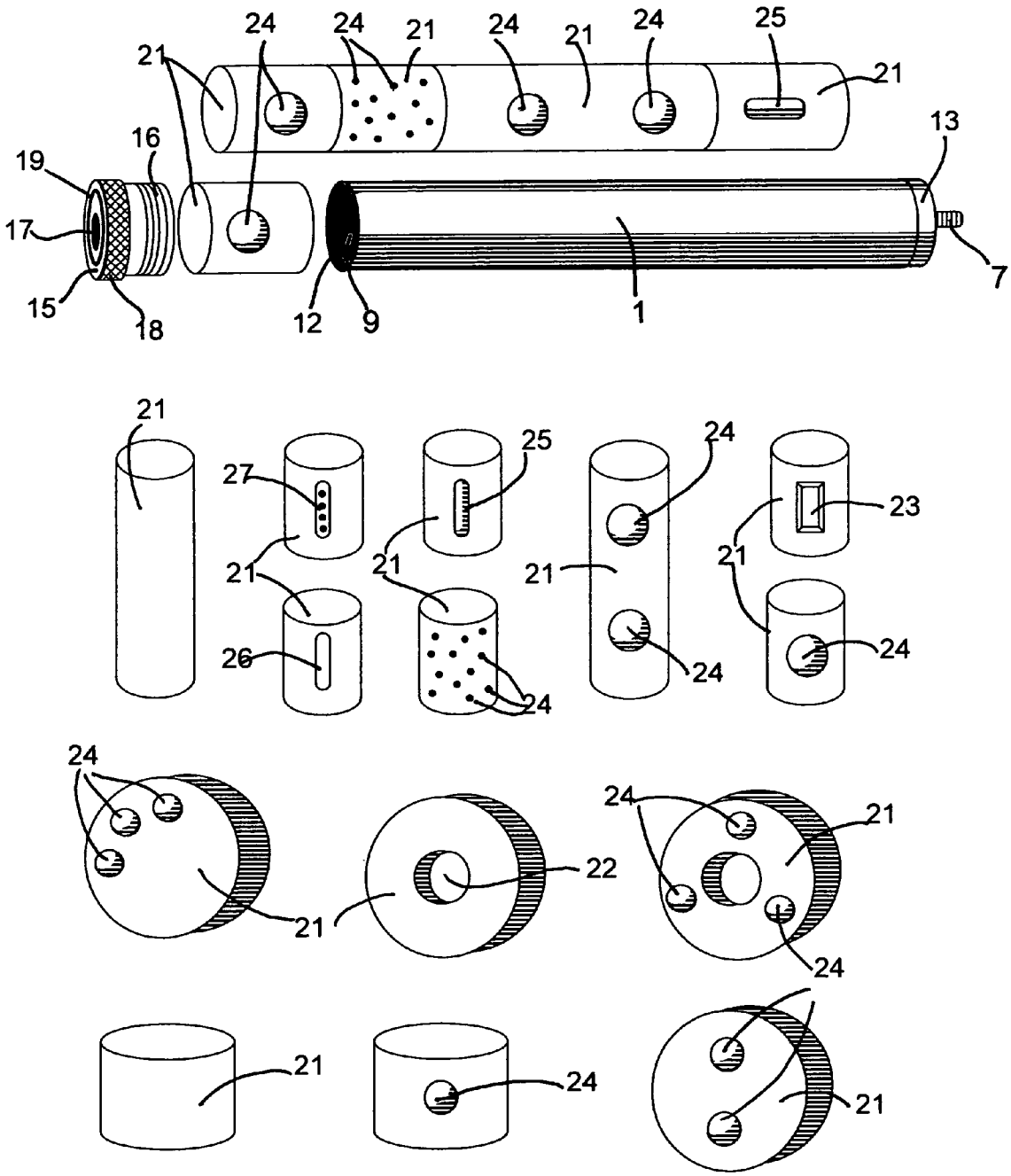
FIG. 10 Shows a view of a variety of shapes, sizes and weights of the elastomer modular units, according to preferred embodiments of this invention.
Figure 11:
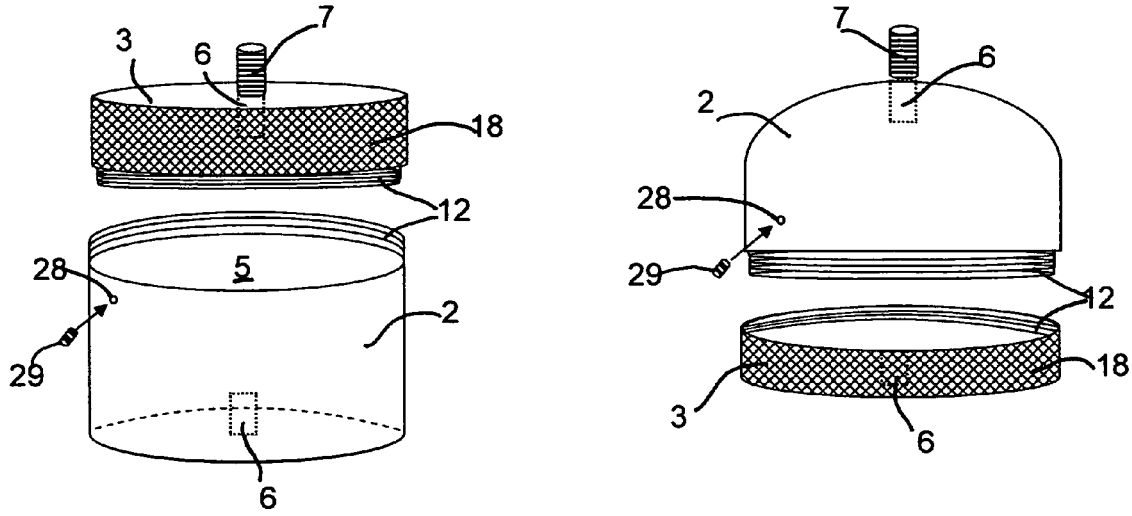
FIG. 11 Shows a view of canister-type stabilizers, according to preferred embodiments of this invention.
Figure 12:
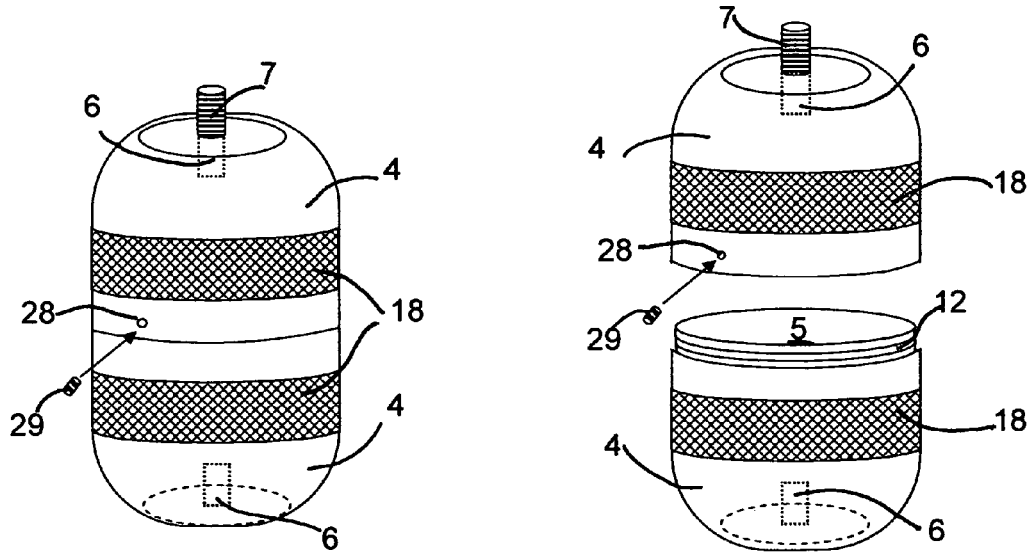
FIG. 12 Shows a view of other shaped stabilizer housings, according to preferred embodiments of this invention.

Referring to FIG. 1 through FIG. 12, bow stabilizer for an archery bow, FIG. 1, is comprised of a hollow stabilizer housing; tubular (1), or in a canister form (2) with lid (3), or other shapes (4), thus creating a hollow chamber (5). Hollow body stabilizer housings (1,2,4) are fabricated from any material that is lightweight and rigid. Referring to FIG. 10, FIG. 11 and FIG. 12, hollow body stabilizer housing (1,2,4) attaches to an archery bow via a threaded hole (6) and a protruding threaded rod or stud (7), wherein a threaded hole (8), FIG. 1, is provided on the archery bow at locations where it is desirable to attach the hollow body stabilizer housings (1,2,4). Referring to FIG. 1, FIG. 10, FIG. 11 and FIG. 12, hollow body stabilizer housings (1,2,4) attach to other hollow body stabilizer housings (1,2,4) via threaded holes (6,14,17) and a protruding threaded rod or stud (7), where it is desirable to attach the hollow body stabilizer housing (1,2,4).

Figure 3:
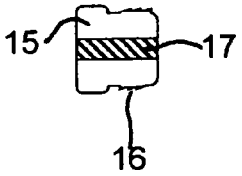
FIG. 3 Shows a cross section view of a threaded insert, according to one preferred embodiment.
Figure 2:
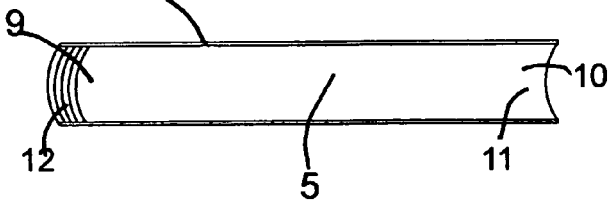
FIG. 2 Shows a cross section view of a tubular hollow stabilizer housing, according to one preferred embodiment of this invention.
Figure 4:
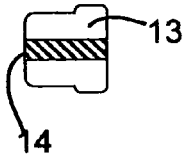
FIG. 4 Shows a cross section view of a smooth insert, according to one preferred embodiment of this invention.
Figure 6:
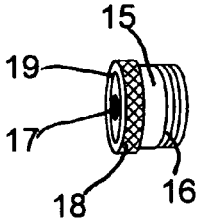
FIG. 6 Shows a threaded insert, according to one preferred embodiment of this invention.
Figure 5:
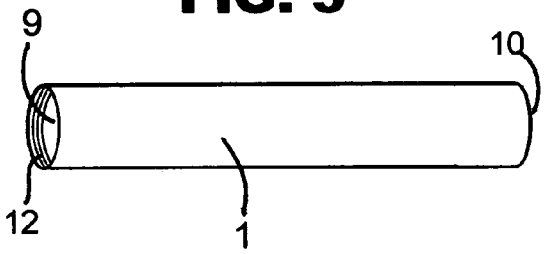
FIG. 5 Shows a tubular stabilizer housing, according to one preferred embodiment of this invention.
Figure 7:
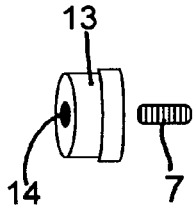
FIG. 7 Shows a smooth insert, according to one preferred embodiment of this invention FIG. 8 Shows a view of three tubular stabilizer housings joined together, according to one preferred embodiment of this invention.
Figure 8:
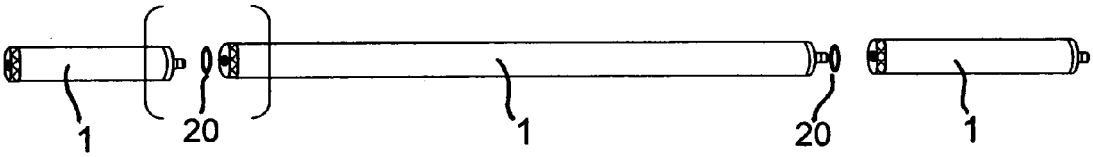
Figure 9:
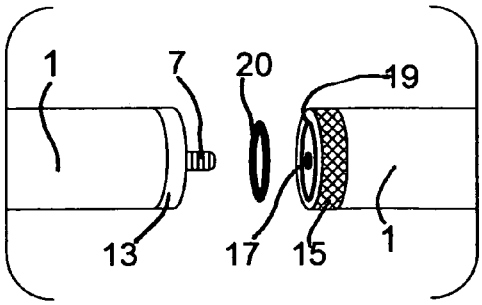
FIG. 9 Shows an exploded view of two tubular stabilizer housings at the joint, according to preferred embodiments of this invention.

Referring to FIG. 2 through FIG. 9, a hollow stabilizer housing of the tubular configuration (1) can have two open ends (9 and 10). One end (10) can have a smooth internal surface (11). The other end (9) can have a threaded internal surface (12). Insert (13) made of aluminum or other lightweight rigid material, is attached permanently in the smooth opening (11). Insert (13) has a threaded hole (14) in its center that will accept the threaded stud (7) of other stabilizer housings or its own stud (7) that is permanently affixed. Stabilizer housing (1) attaches to any archery bow (FIG. 1) by the threaded stud (7) that engages the threaded female coupling (8) of the archery bow (FIG. 1) or other stabilizer housings (1,2,4) to facilitate releasable interconnection of the stabilizer housing (1) from the bow. Insert (15), FIG. 3, is also made of aluminum or other lightweight rigid material. Insert (15) is threaded (16) to engage threaded end (12) of the hollow stabilizer housing (1). Insert (15) has a threaded hole (17) in its center that will accept the threaded stud (7) of other stabilizer housings (1,2,4) of like design. Insert (15) can have knurling (18) or other textured surface to facilitate removing and replacing threaded insert (15). Both inserts (13 and 15) have O-ring grooves (19) on their flat externally facing surfaces, to further facilitate the joining of other stabilizer housings of like design with O-rings (20), FIGS. 8 and 9.

Referring to FIGS. 10, 11, and 12, a unique dampener material, made of extremely soft, dense elastomer (21) is molded into modular units of varying shapes, sizes and weights and may or may not have a hole (22) in the center, depending on what is needed inside the hollow stabilizer housing (1,2,4). The elastomer modules may or may not have weights molded inside them, or other vibration dampening material. The contents of these variable weighted internal elastomer modules can include, but are not limited to, steel or lead shot or ball bearings (24), weight rods (25), capsules filled with fluid (26), or fluid plus weighted pellets (27), sealed liquid packets, or packets and/or bags of granular material, (23), or a combination of granular weight inside of a liquid in a capsule or sealed receptacle (not shown). Any or all of these can be suspended and/or sealed and/or molded inside the elastomer (21).

Referring again to FIG. 10, the removable threaded insert (15) is removed and the elastomer modular units (21) are placed into the hollow stabilizer housing (1) to the personal specifications or needs of the archer. The threaded insert (15) is then replaced by the archer.

Referring to FIG. 11, hollow stabilizer housing of the canister shape (2) is also made of aluminum or other lightweight rigid material. The two-part canister stabilizer housing can be made up of the threaded canister body (2) and a threaded housing lid (3) or any locking and unlocking lid system, for easy removal by the archer. The lid (3) can have knurling (18) or other textured surface to facilitate removing and replacing the threaded lid (3). Both canister body (2) and lid (3) can have threaded surfaces (12) that engage each other. Both canister body (2) and lid (3) can have threaded holes (6) in the centers that will accept the threaded stud (7) of other stabilizer housings (1,2,4) or its own stud (7) that is permanently affixed. The canister body (2) has a small threaded hole (28) to accept a like threaded set screw (29). This small threaded set screw (29) is to be tightened to help hold the lid (3) in place against vibration. Canister stabilizer housing (2) and its threaded lid (3) attaches to any archery bow (FIG. 1) by the threaded stud (7) that engages the threaded female coupling (8) of the archery bow (FIG. 1) or other stabilizer housings (1,2,4) to facilitate releasable interconnection of the stabilizer housing (2) from the bow (FIG. 1) or other stabilizer housings (1,2,4). The removable threaded lid (3) is removed and the elastomer modular units (21) are placed into the canister body (2) to the personal specifications or needs of the archer. The archer then replaces the threaded lid (3) and the set screw (29) is tightened.

Referring to FIG. 12, hollow stabilizer housing (4), which can be in the shape of an elongated square, hexagon, octagon or any other shape (4), is also made of aluminum or other lightweight rigid material. Both halves of this two part canister stabilizer housing (4) of varying shapes can have threaded surfaces (12) that engage each other for easy removal of the elastomer (21) by the archer. The two halves of the hollow stabilizer housing (4) can have knurling (18) or other textured surfaces to facilitate removing and replacing the threaded canister body halves (4). Both halves have threaded holes (6) in the centers that will accept the threaded stud (7) of other stabilizer housings (1,2,4) or its own stud (7) that is permanently affixed in one half. One canister body half has a small threaded hole (28) to accept a like threaded set screw (29). This small threaded set screw (29) is to be tightened to help hold the canister body halves together against vibration. This stabilizer housing (4) attaches to any archery bow (FIG. 1) by the threaded stud (7) that engages the threaded female coupling (8) of the archery bow (FIG.

1) or other stabilizer housing (1,2,4) to facilitate releasable interconnection of the stabilizer housing (4) from the bow (FIG. 1) or other stabilizer housings (1,2,4).

The removable threaded, or otherwise securable, halves (4) are separated and the elastomer modular units (21) are placed into the hollow stabilizer housing (4) to the personal specifications or needs of the archer. The threaded halves are then replaced by the archer and the set screw (29) is tightened.

I claim:

1. A stabilizer for an archery bow, comprising:

a rigid hollow housing, having an end plug at a first end, and an end cap at a second end; a threaded rod extending from the end cap and adapted to engage a threaded hole on an archery bow;

the housing having a central axis in line with the rod and intersecting the bow;

the end plug adapted to be readily removed from and secured to the first end of the housing by a user;

a plurality of soft, dense, elastomer modular units received within the housing, the units of a size and shape as to be readily removable from and replaceable within the housing by a user, in a desired sequence and orientation;

at least one of the elastomer units having a weight distribution which is non-symmetric about the central axis;

the plurality of elastomer units having an uncompressed combined length slightly greater than the length of the housing between the end plug and the end cap, so when the end plug is placed on the housing containing the elastomer units, the elastomer units are held in direct compressive contact within the housing.

2. The stabilizer of claim 1, in which at least one of the elastomer modular units includes a weight suspended therein.

3. A kit for constructing a bow stabilizer, including:

a rigid hollow housing, having an end plug at a first end, a threaded rod extending from the end cap and adapted to engage a threaded hole on an archery bow;

the housing having a central axis in line with the rod;

an end plug adapted to be readily removed from and secured to the first end of the housing by a user;

a plurality of soft, dense, elastomer modular units adapted to be received within the housing, the units of a size and shape as to be readily removable from and replaceable within the housing by a user, in a desired sequence and orientation;

at least one of the elastomer units being different from another of the elastomer units in at least one of weight, weight distribution, or length;

at least one of the elastomer units having a weight distribution which is non-symmetric about the central axis, when contained within the housing;

the housing of a length to receive at least two of the elastomer units, in a desired sequence and orientation, between the end plug and end cap.

4. The stabilizer kit of claim 3, in which at least one of the elastomer modular units includes a weight suspended therein.

* * * * *